US005462096A

United States Patent [19]

Svanstroem et al.

[11] Patent Number: 5,462,096

[45] Date of Patent: Oct. 31, 1995

[54] MEASURING WEFT FEEDER WITH YARN CLAMPING ACTION

[75] Inventors: Anders Svanstroem, Ulricehamn; Paer Josefsson, Borås, both of Sweden

[73] Assignee: IRO AB, Ulricehamn, Sweden

[21] Appl. No.: 199,234

[22] PCT Filed: Aug. 21, 1992

[86] PCT No.: PCT/EP92/01927

§ 371 Date: Jul. 5, 1994

§ 102(e) Date: Jul. 5, 1994

[87] PCT Pub. No.: WO93/04225

PCT Pub. Date: Mar. 4, 1993

[30] Foreign Application Priority Data

Aug. 22, 1991 [DE] Germany ..... 41 27 798.8

[51] Int. Cl.[6] ..... D03D 47/36

[52] U.S. Cl. ..... 139/452

[58] Field of Search ..... 139/452

[56] References Cited

U.S. PATENT DOCUMENTS

| | | | |
|---|---|---|---|
| 4,627,474 | 12/1986 | Tholander | 139/452 |
| 4,632,155 | 12/1986 | Maina | 139/452 |
| 4,781,225 | 11/1988 | Van Donk et al. | 139/452 |
| 5,007,464 | 4/1991 | Gorris | 139/452 X |
| 5,201,347 | 4/1993 | Maina | 139/452 |
| 5,271,435 | 12/1993 | Maina | 139/452 |

FOREIGN PATENT DOCUMENTS

| | | |
|---|---|---|
| 0250359 | 12/1987 | European Pat. Off. . |
| 0441288 | 8/1991 | European Pat. Off. . |

*Primary Examiner*—Andy Falik

*Attorney, Agent, or Firm*—Flynn, Thiel, Boutell & Tanis

[57] ABSTRACT

A measuring melt felder (M) has a storage body (F) for the thread (Y) wound in turns (W) and at least one stopping device (S) outwardly associated to the storage body (F) that delimits a thread (Y) passage slot (A). A stopping element (P) capable of moving transversely through the passage slot (A) to a stopping position acts as a circumferential stop (B) for the thread (Y). The stopping device (S) has, associated with the stopping element (P), an adjustable thread clamp (K) for the thread (Y) held at the stopping element (P).

11 Claims, 2 Drawing Sheets

MEASURING WEFT FEEDER WITH YARN CLAMPING ACTION

The present invention refers to a measuring weft feeder which utilizes a yarn clamping device to prevent defects caused by yarn slippage and/or loose turns of yarn on the storage surface of the weft feeder.

BACKGROUND OF THE INVENTION

Measuring weft feeders are normally used for feeding jet looms with weft yarn, the stopping element being used for limiting the weft yarn length and being removed from the passage slot for such a period of time that the exact weft yarn length is drawn off, the yarn circulating around the storage body in the course of this process. In the stopping position, the stopping element defines the circumferential stop for the circulating yarn. The stopped yarn extends from the last turn on the storage surface at an oblique angle to the stopping element and then approximately axially to a yarn guide element or a yarn-insertion or auxiliary nozzle exerting a pulling force on the yarn. At the end of the yarn-insertion movement, a whipping effect will occur when the yarn has struck the stopping element, said whipping effect causing a noticeable increase in the yarn tension and, subsequently, a relief of yarn tension, and this will exert an influence on the turns of yarn up to the last turns on the storage surface. The tension of the last turns of the yarn will be relieved to such an extent that these turns will hang down freely. This may result in a displacement of the turns and it may interfere with the next insertion. It may also happen that a loose last turn falls off the storage surface without any external influence so that the next weft yarn will then be too long. A turn falling down may wind itself around the stopping device and cause yarn breakage. Several superimposed turns may be registered as one turn during the next insertion, and this will result in malfunction. When the yarn geometry is changed between the measuring weft feeder and the edge of the woven fabric during the working cycle of the loom, very lively and highly twisted yarn qualities tend to slip away below the stopping element due to the pulling force exerted by the yarn-insertion or auxiliary nozzle, even if said stopping element engages a recess provided in the storage surface. This will result in incorrect weft yarn lengths and in yarn defects which will be visible in the woven fabric later on. In order to eliminate this disadvantage, the stopping element must move deeply into the recess with a long operating stroke and this necessitates an expensive and strong operating magnet having a delayed response behaviour.

SUMMARY OF THE INVENTION

It is the object of the present invention to provide a measuring weft feeder of the type described at the beginning in the case of which yarn defects caused by loose turns on the storage surface or by a yarn slipping away below the stopping element are avoided.

In accordance with the present invention, this object is achieved by use of a measuring weft feeder that includes a storage body where yarn is stored by being wound thereon, a stopping device which defines a passage area where yarn passes through when being unwound off of said storage body, and a stopping element, which when placed in a stopping position, is moved transversely through the passage area so as to form a circumferential stop which prevents yarn from further unwinding off of said storage body by placing an oblique force upon the yarn. In addition, a yarn clamp, which is connected to and displaced by said stopping element, is used to prevent tension forces being created in and displaced throughout the yarn when it strikes the stopping element. When the stopping element is displaced through the passage area so as to function as a circumferential stop, the yarn clamp is placed in a passive clamping position. In this position, a direct clamping force is applied upon the yarn, thereby preventing tension from building up in the stored yarn when it strikes the stopping element.

In the case of this structural design, the yarn caught at the stopping element is stabilized by the yarn clamp to such an extent that the turns of the yarn on the storage surface will no longer loosen due to the increase in and relief of yarn tension downstream of the measuring weft feeder so that even lively, highly twisted yarns will no longer slip under the stopping element. The yarn clamp prevents the yarn from sliding back and it also prevents loosening of the yarn directly at the stopping element, since it fixes the yarn in a comparatively large area thereof. In view of the fact that the yarn clamp is adapted to be controlled, it will no longer exert any negative influence during the drawing-off movement of the yarn. The yarn clamp will be come effective precisely at the moment at which a critical condition of the stopped yarn occurs.

BRIEF DESCRIPTION OF THE DRAWINGS

Embodiments of the subject matter of the invention are explained on the basis of the drawings, in which.

DETAILED DESCRIPTION

Figure 1:
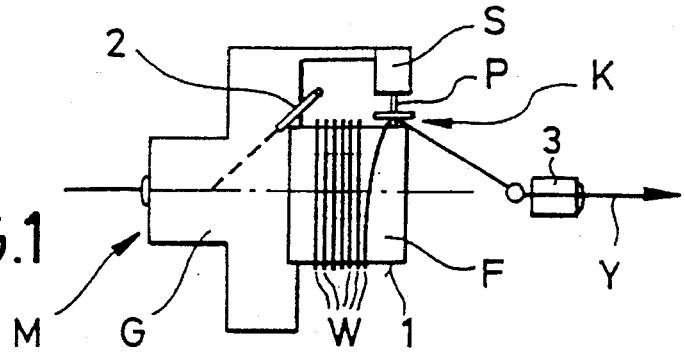
FIG. 1 shows a schematic side view of a measuring weft feeder.

A measuring weft feeder M according to FIG. 1 serves to feed e.g. an air-jet loom (not shown) with weft yarn sections having an exactly measured length, said weft yarn sections being drawn off successively. The measuring weft feeder M comprises a housing G having arranged thereon a storage body F in the form of a drum which is provided with an external storage surface 1 for the yarn Y wound in turns W onto said storage surface 1 by a winding member 2. The yarn Y is drawn off a yarn supply coil, which is not shown, and is inserted into the measuring weft feeder M where it is wound in successive turns onto the storage surface 1 by the winding member 2, said winding member being adapted, to be driven such that it rotates. From said storage surface 1, the yarn Y is drawn off overhead (i.e. over one end of the drum) below a stopping device S, which is attached to the housing G, by means of a weft-insertion or auxiliary nozzle 3. The stopping device S includes a selectively extendable stopping element P and a controllable yarn clamp K.

Figure 2A:
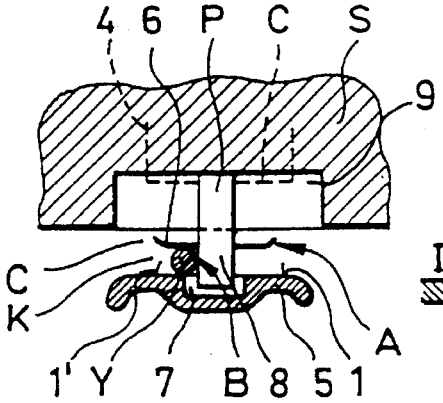
FIGS. 2A, 2B, and 2C show three associated views of a first embodiment, FIG. 2C being a view in the plane I—I of FIG. 2B, FIG. 3A, 3B, and 3C show associated views of two additional variants of embodiments.
Figure 2B:
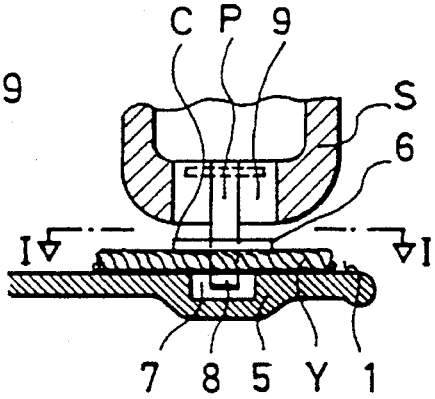
Figure 2C:
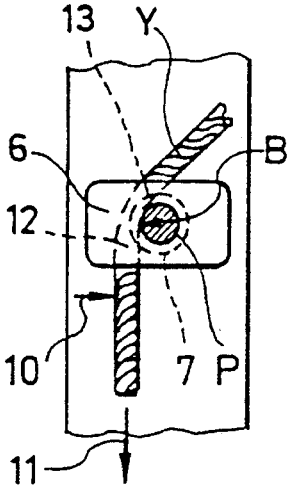

According to FIGS. 2A, 2B and 2C, the storage surface 1 is provided with axial fingers 5 distributed in the circumferential direction. One finger 5 is in alignment with the stopping device S and it is provided with a recess 7 for a free end 8 of the stopping element P which is constructed as a pin. By means of an operating magnet 4, the stopping element P can be moved up to and into the recess 7 to the stopping position shown and retracted with the aid of a restoring spring, which is not shown. It is, however, also possible to push out the stopping element P by means of a pushing spring (not shown) and to retract it with the aid of the operating magnet 4 against the force of the pushing spring.

A passage slot A is defined between the stopping device S and the storage surface 1, the yarn Y passing through said passage slot A upon being drawn off in the circumferential direction. The yarn clamp K, which is arranged on the stopping device S, is provided with a clamping element C, in the present case a lamina or plate 6 with bent-up edges, which is positioned on the stopping element P and which is adapted to be moved together therewith from a position of rest indicated by the broken lines to the clamping position shown by the solid lines. The stopping element P forms a circumferential stop B for the yarn Y. The storage surfacer 1 forms a passive clamping surface 1' with which the clamping element C cooperates so as to clamp the yarn Y abutting on the stopping element P.

The stopping device S has provided therein an opening 9 for the clamping element C, said opening 9 being open at the bottom and being adapted to the shape of the clamping element C so that, when the stopping element P and the clamping element C are retracted, the yarn Y which may perhaps have been raised together therewith will be stripped off the free end 8. FIG. 2C shows clearly how the yarn comes into contact with the circumferential stop B after having been drawn off in the circumferential direction 10. The yarn has applied thereto a pulling force in the direction of an arrow 11 by means of the weft-insertion or auxiliary nozzle 3 and it is held in an approximately axially stretched condition. Upstream of the stopping element P, the yarn Y extends at an oblique angle to the next turn of the yarn on the storage surface 1. The clamping element C is large enough for extending beyond the edge of the engagement recess 7 and for fixing the yarn at least in two spaced-apart areas 12 and 13 so that the yarn Y cannot slip away below the free end 8 of the stopping element P.

Figure 3A:
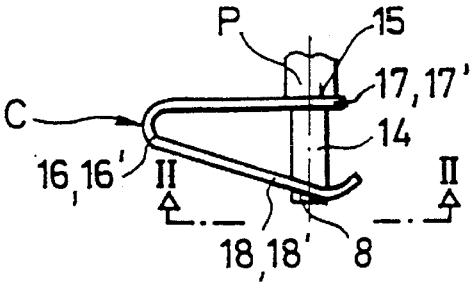
Figure 3B:
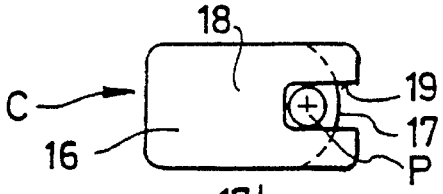
Figure 3C:
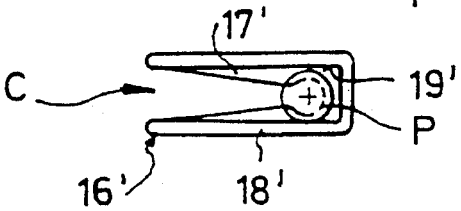

In the embodiment according to FIG. 3A, the clamping element C is a leaf spring 16 which is bent into a U-shape or V-shape and which has its upper leg 17 secured in position on a shoulder 15 of the stopping element P. The lower leg 18 of said leaf spring 16 is movably guided on a lower part 14 of the stopping element P via a recess 19. It will be expedient to pretension the leaf spring 16 so that the leg 18 will be slightly raised when the yarn Y strikes the lower part 14 of the stopping element P and clamp the yarn Y in position. In the view from below of FIG. 3B, it can be seen that, if necessary, the lower leg 18 rests on the stopping element P so that it is guided thereon, said lower leg 18 being, however, still movable. In the embodiment according to FIG. 3C, which corresponds with the view of FIG. 3A, the clamping element C is a spring-wire bow 16' whose upper leg 17' is secured in position at the stopping element P and whose lower leg 18' is guided on said stopping element or extends round said stopping element with a certain amount of lateral play (recess 19'). Also the spring-wire bow 16' clamps the yarn Y, just as in FIG. 2C, at both sides outside of the engagement recess 7 on the passive clamping surface 1'.

The embodiments above are advantageous insofar as, due to the movement of the stopping element, the yarn clamp is displaced to a passive clamping position and is there ready to act on the yarn. When the yarn strikes the stopping element, the weft yarn will be an exactly measured length, and the yarn will fix itself automatically in the position so that there will be no inadmissable relief of the tension of the last turns of yarn on the storage surface, thereby preventing yarn from slipping away below the stopping element. The yarn is held comparatively stretched at the stopping element between at least two clamping points by means of the yarn clamp. It is thus possible to choose a small penetration depth of the stopping element as well as a short operating stroke for the stopping element, thus permitting the use of an inexpensive and rapidly responding operating magnet or pushing spring by means of which the stopping element is extended only a short stroke.

Figure 4A:
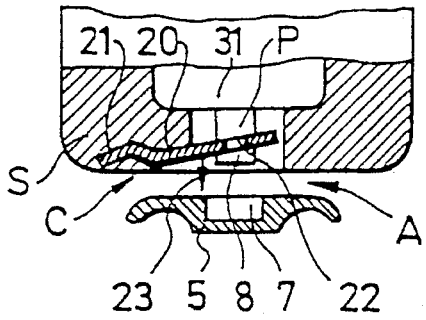
FIGS. 4A, 4B, and 4C show three associated views of an additional embodiment.
Figure 4B:
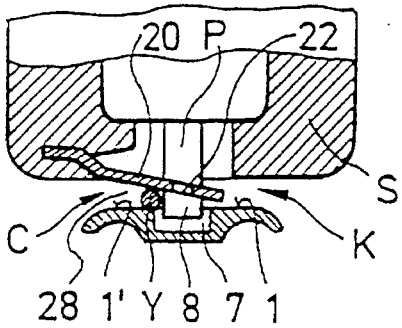
Figure 4C:
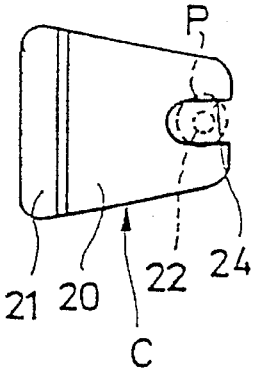

According to FIGS. 4A, 4B and 4C, the clamping element C is a leaf spring or a spring-steel component 20 which has been produced by punching or stamping and which has a fastening end 21 and a mouthlike cut-out portion 24 at the free end thereof. The leaf spring 20 is supported in the stopping device S via its fastening end 21. The mouthlike cut-out portion 24 extends round a transverse groove 22 of the stopping element P above the free end 8 of said stopping element P. The magnet 31 of the stopping element can be so strong that it will deflect the leaf spring 20 from the position of rest shown in FIG. 4A together with the stopping element P into the clamping position shown in FIG. 4B in which the yarn Y caught at the stopping element P is pressed against the passive clamping surface 1' on the storage surface 1. It is, however, just as well possible to pretension the leaf spring 20 in the direction of an arrow 23 and to fix it in the stopping device S in such a way that it will serve as a pushing spring for the stopping element P and push out said stopping element P as soon as the magnet 31, which is constructed as a restoring magnet, is de-excited. Furthermore, it would be possible to pretension the leaf spring 20 upwards as a restoring spring so that it will act against the magnet 31 serving as a pushing magnet. For the clamping element C, the opening 9 is provided in the stopping device S so as to keep the passage slot A free for the yarn Y in the position of rest. FIG. 4C shows a top view of a possible shape of the leaf spring 20.

Figure 5A:
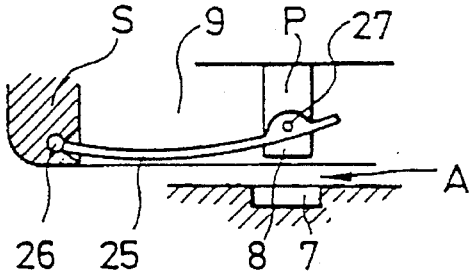
FIGS. 5A, and 5B show an additional embodiment in two different positions.
Figure 5B:
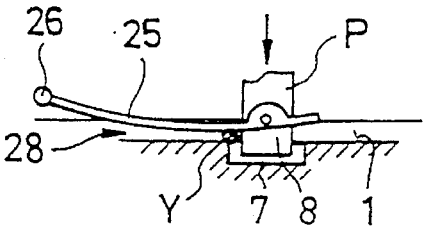

In the embodiment according to FIG. 5A, the stopping element P serves as a driver for the clamping element C, which consists e.g. of a bent leaf spring 25, a lamina of plastic material, a wire bow or the like, and which is pivotably supported in the stopping device S in a pivot bearing 26. A driver connection 27 between the stopping element P and the clamping element C guarantees that, in the stopping position of the stopping element P (FIG. 5B), the clamping element will move at least partially from the stopping device S into the passage slot A and clamp the yarn Y as soon as said yarn Y has come into contact with the stopping element P. In the clamping position, the clamping element defines together with the storage surface 1 a clamping nip 28 which narrows in the direction of the stopping element P and in which the yarn Y is decelerated in the course of its movement towards the stopping element P. The clamping element C can be constructed such that it has little mass so that the actuating force applied by the stopping element P will remain small.

Figure 6A:
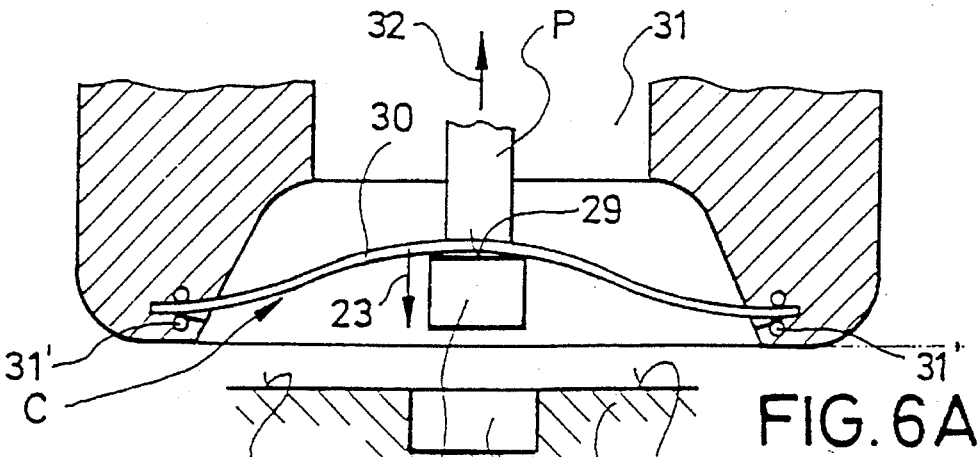
FIGS. 6A, and 6B show an additional embodiment in two different positions and in a drawing shown partly in section.
Figure 6B:
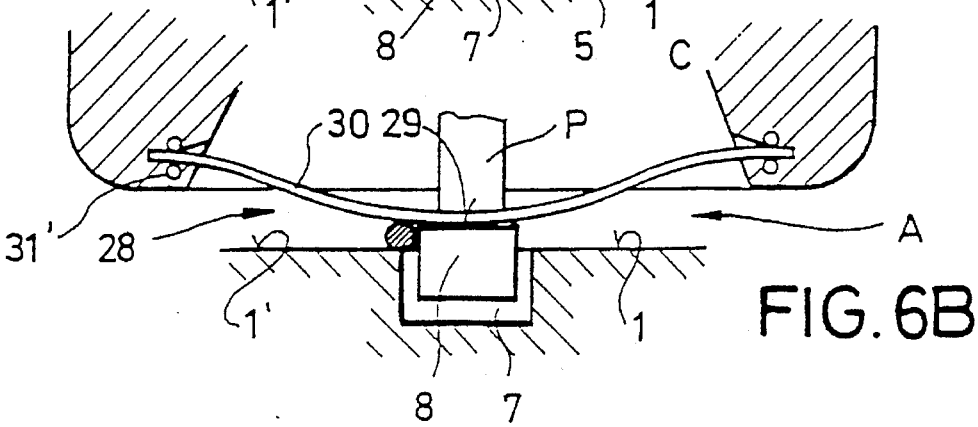

FIG. 6A shows an additional embodiment in the position of rest, whereas FIG. 6B shows said embodiment in the stopping or clamping position. The clamping element C is a leaf spring 30 pretensioned in the direction of an arrow 23, said leaf spring 30 having its ends supported in the stopping device S at 31' and resting on a shoulder 29 of the stopping element P in the central area thereof. The magnet 31 is constructed as a traction magnet which, when excited, generates a tractive force in the direction of the arrow 32. For moving the stopping element P to the stopping position according to FIG. 6B, the magnet 31 is de-excited so that the leaf spring 30 will urge the stopping element P into the engagement recess 7 provided in the storage surface 1. At the same time, the leaf spring 30 partly enters the passage slot A for clamping the yarn Y which has arrived at the stopping element 8 and for defining a clamping nip which narrows in the direction of the stopping element P. The opening 9 in the stopping device S is adapted to the shape of the leaf spring 30 at least in the outlet area thereof so that the abutting yarn Y will be stripped off when the stopping element P is being raised.

It would just as well be, possible to support the leaf spring 30 according to FIG. 6A and 6B such that it is pretensioned in the opposite direction and to use it as a restoring spring for the stopping element P. In this case, it would be necessary that the magnet 31, when excited, generates a magnetic force acting in the direction of the arrow 23.

The yarn clamp K arranged in the stopping device S could just as well be provided with a structural design deviating from the embodiments shown. The important point is that the yarn clamp is moved and advanced to its clamping position and displaced to its position of rest in synchronism with the stopping element so that it will only become effective if also the stopping element fulfills its stopping function. Due to the arragnement of the yarn clamp in the stopping device, a separate holding means for said yarn clamp can be dispensed with. Furthermore, it is not necessary to provide an independent control for the yarn clamp, since said yarn clamp makes use of the stopping device or rather of the stopping element.

An advantageous expedient of the present invention is that the yarn clamp is actuated in synchronism with the stopping element when said stopping element has to catch the yarn, whereas the yarn clamp will remain inactive when also the stopping element is passive.

Also, a structurally simple arrangement is provided in the embodiment in which the storage surface defines the passive clamping surface so that a simple clamping element will suffice for fixing the yarn. In view of the fact that the clamping element is supported in an opening of the stopping device in its position of rest, the yarn, which may perhaps be entrained when the stopping element is being retracted, can be stripped off.

An alternative and reliable embodiment is disclosed due to the fact that the clamping element is supported in the stopping device such that it is adapted to be deflected and need not be moved by any component other than the stopping element, so that the actuating force which the stopping element has to apply to the yarn clamp is very small. The response behavior of the stopping device will not noticeably be impaired.

Further, in the case in which the clamping element fixes the yarn outside of the edge of the engagement recess at several points, even if a small penetration depth has been chosen for the stopping element, the yarn will not slip away below the stopping element.

Also, a structurally simple, functionally reliable and space-saving embodiment is disclosed since, by means of a leaf spring, it will additionally be possible to achieve a desirable elasticity and, consequently, a deceleration of the unwinding operation which becomes effective gradually when the yarn is being clamped.

A particularly advantageous embodiment is also disclosed wherein the leg of the leaf spring which faces the passage slot and which is movably guided on the stopping element clamps the yarn gently but reliably. Moreover, the movable lower leg of the leaf spring will strip off the yarn when the stopping element is being retracted. The retracting movement of the stopping element may be supported by the leaf spring the tension of which is relieved.

In the case of the embodiments wherein the clamping element has an additional function causing the stopping element to move in the pushing direction or in the restoring direction, components in the stopping device which have hitherto been necessary for this purpose, e.g. a pushing spring or a restoring spring, are either no longer necessary or they can be constructed as weak components which will, consequently, have small dimension.

Although a particular preferred embodiment of the invention has been disclosed in detail for illustrative purposes, it will be recognized that variations or modifications of the disclosed apparatus, including the rearrangement of parts, lie within the scope of the present invention.

We claim:

1. A measuring weft feeder comprising a storage body defining a storage surface for a yarn wound in turns thereon, and further comprising at least one stopping device associated with said storage body and cooperating therewith to define a passage slot therebetween for the yarn, said stopping device including a stopping element which is movable transversely through the passage slot from a nonstopping position to a stopping position so as to act as a circumferential stop for the yarn, the improvement wherein the stopping device is provided with a yarn clamp for the yarn caught at the stopping element, said stopping device including displacement means for displacement of said yarn clamp from a position of rest to a clamping position lying in the passage slot, said displacement means including means for maintaining said clamp in the position of rest when the stopping element is in the nonstopping position to allow the yarn to be freely unwound off of the storage body, said displacement means further including means for displacing said clamp into said clamping position when the stopping element moves or has moved through the passage slot into the stopping position for directly clamping the yarn with said clamp at the side of and adjacent to the stopping element.

2. A measuring weft feeder according to claim 1, wherein the yarn clamp includes a passive clamping surface arranged on the storage surface and at least one active clamping element supported in an opening of the stopping device outside of the passage slot when in its position of rest and being movable by said means for displacing towards the passive clamping surface into said clamping position.

3. A measuring weft feeder according to claim 1, wherein the yarn clamp includes a clamping element arranged on the stopping element.

4. A measuring weft feeder according to claim 1, wherein the yarn clamp includes a clamping element supported in the stopping device and being deflectable into the clamping position by said means for displacing, said clamping element having at least a part thereof connected to the stopping element such that it moves together therewith.

5. A measuring weft feeder according to claim 1, wherein the storage surface has provided therein an engagement recess for a free end of the stopping element, and wherein the yarn clamp when in the clamping position includes a clamping element which extends from the stopping element up to and outwardly beyond an edge of the recess.

6. A measuring weft feeder according to claim 2, wherein the clamping element is a leaf spring or a bow spring selected from the group consisting of spring wire, plastic material or sheet metal.

7. A measuring weft feeder according to claim 2, wherein the clamping element has a U-shape or V-shape in the form of a pretensioned leaf spring or wire bow and has a first leg fixed in position on the stopping element and a second leg guided on said stopping element such that it is movable relative thereto at least in the direction of movement of the stopping element, and said second leg is arranged in spaced relationship from the first leg and faces the passage slot when the clamp is in said position of rest.

8. A measuring weft feeder according to claim 2, wherein the clamping element is defined by a pushing spring which is supported in the stopping device and is pretensioned to act on and bias the stopping element toward the stopping position.

9. A measuring weft feeder according to claim 2, wherein the clamping element is defined by a restoring spring which is supported in the stopping device and is pretensioned to act on and bias the stopping element toward the nonstopping position.

10. A measuring weft feeder according to claim 2, wherein the clamping element, when in its clamping position in the passage slot, defines a clamping nip narrowing in a direction toward the stopping element and defines a yarn brake for decelerating a yarn unwinding operation.

11. A measuring weft feeder according to claim 1, wherein said means for displacing includes said stopping element which moves said yarn clamp from the position of rest to the clamping position.

* * * * *

UNITED STATES PATENT AND TRADEMARK OFFICE

CERTIFICATE OF CORRECTION

PATENT NO. : 5 462 096

DATED : October 31, 1995

INVENTOR(S) : Anders SVANSTROEM, et al

It is certified that error appears in the above-indentified patent and that said Letters Patent is hereby corrected as shown below:

On the title page, item [54] and in column 1; change title "MEASURING WEFT FEEDER WITH YARN CLAMPING ACTION" to ---MEASURING WEFT FEEDER WITH YARN CLAMP ASSOCIATED WITH A STOPPING ELEMENT---.

On the title page, item [57], in column 2, Abstract, line 1; change "melt felder" to ---weft feeder---.

Signed and Sealed this

Ninth Day of April, 1996

Bruce Lehman

*Attest:*

BRUCE LEHMAN

*Attesting Officer*

*Commissioner of Patents and Trademarks*